United States Patent [19]

Stuart

[11] 3,984,276

[45] Oct. 5, 1976

[54] MACHINE FOR TAPING CAPACITORS AND THE LIKE

[75] Inventor: Donald J. Stuart, Park Ridge, Ill.

[73] Assignee: Midland Engineering and Machine Co., Rosemont, Ill.

[22] Filed: Oct. 24, 1974

[21] Appl. No.: 517,790

[52] U.S. Cl. ..... 156/366; 156/446; 156/475; 156/494; 156/510

[51] Int. Cl.[2] ..... B65C 3/02; B65C 3/10

[58] Field of Search ..... 156/185, 353, 355, 366, 156/443, 446, 468, 492, 510, 580, 494, 475, 538; 53/198 R

[56] References Cited

UNITED STATES PATENTS

| | | | |
|---|---|---|---|
| 2,543,323 | 2/1951 | Marsh | 156/355 |
| 3,290,862 | 12/1966 | Lagesse | 53/198 R |
| 3,446,690 | 5/1969 | Charles | 156/446 |
| 3,470,814 | 10/1969 | Tschappu | 53/198 R |
| 3,586,582 | 6/1971 | Inka | 156/468 |
| 3,864,191 | 2/1975 | Tovarys | 156/468 |
| 3,866,812 | 2/1975 | Gutjahr | 156/443 |
| 3,880,699 | 4/1975 | Nishimoto | 156/443 |

*Primary Examiner*—Douglas J. Drummond
*Assistant Examiner*—Basil J. Lewris
*Attorney, Agent, or Firm*—Leydig, Voit, Osann, Mayer & Holt, Ltd.

[57] ABSTRACT

A taping machine for applying a protective wrapping to small parts, particularly electronic parts such as capacitors, having a longitudinal axis. Permanently adhesive tape is fed from a supply roll onto a forwardly inclined table at the front of the machine. Below the front lip of the table are a pair of horizontally extending rollers vertically aligned with one another. Interposed between the lip of the table and the rollers is a reciprocated cutter blade. A third roller mounted upon a swingable arm is bodily movable in triangular relation with respect to the pair of rollers. The end of the tape extends to the lip of the table, sticky side up, so that a part may be manually pressed adheringly to the tape in a transversely extending direction. Interposed between the roll of tape and the table is a swingably mounted knurled roller engaging the sticky side of the tape and about which the tape is looped. A hand wheel swings the roller rearwardly for prestripping a length of tape and then swings the roller forwardly to feed the length of tape across the table so that the part adhering to the tape drops over the lip of the table and into a centered position in front of the pair of rollers. Bodily movement of the third roller traps the part in the triangle between the rollers, and, upon driving the rollers, the part rotates drawing tape from the supply roll. A timer is provided for actuating the cutter when a predetermined amount of tape has been wound about the part.

7 Claims, 14 Drawing Figures

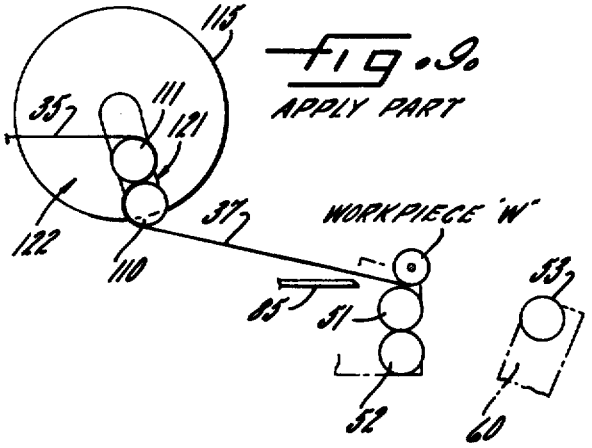
FIG. 9.
APPLY PART
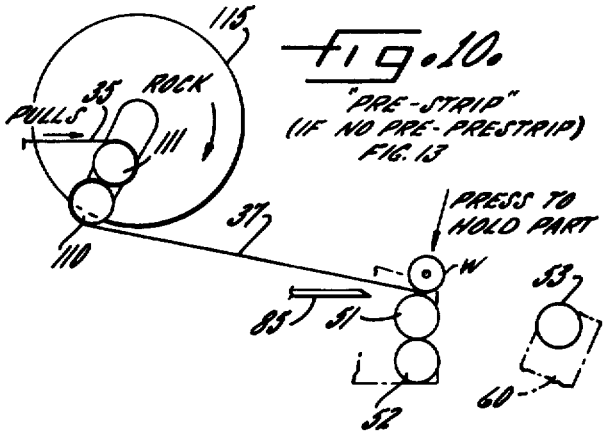
FIG. 10.
"PRE-STRIP"
(IF NO PRE-PRESTRIP)
FIG. 13
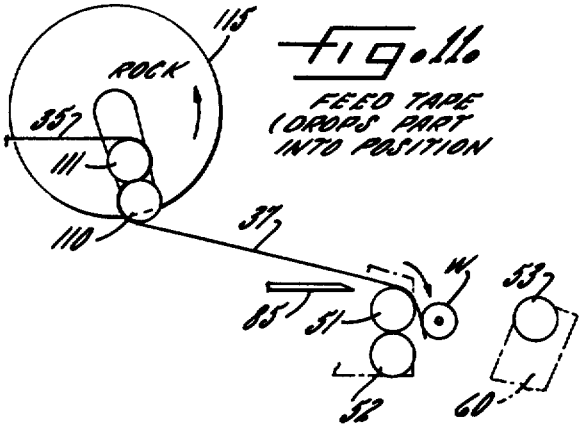
FIG. 11.
FEED TAPE
(DROPS PART
INTO POSITION
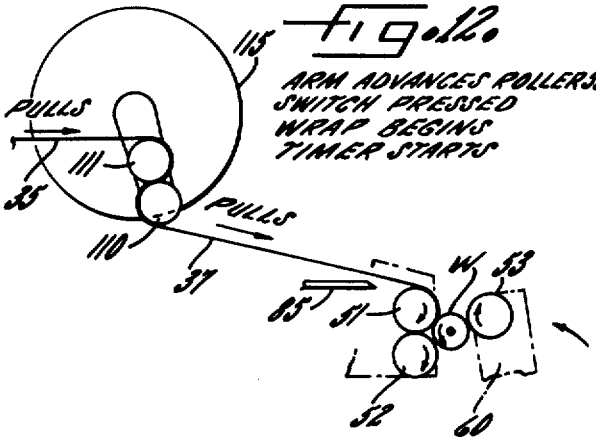
FIG. 12.
ARM ADVANCES ROLLER 53
SWITCH PRESSED
WRAP BEGINS
TIMER STARTS
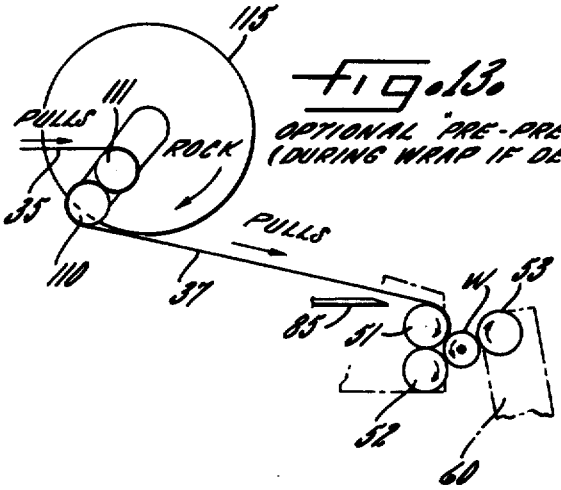
FIG. 13.
OPTIONAL "PRE-PRESTRIP"
(DURING WRAP IF DESIRED)
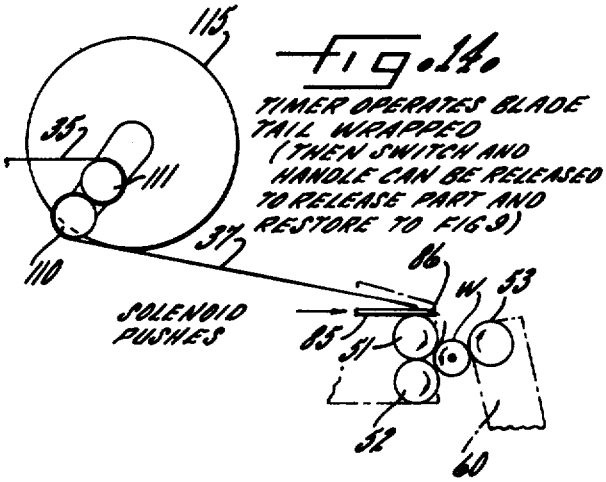
FIG. 14.
TIMER OPERATES BLADE
TAIL WRAPPED
(THEN SWITCH AND
HANDLE CAN BE RELEASED
TO RELEASE PART AND
RESTORE TO FIG 9)

MACHINE FOR TAPING CAPACITORS AND THE LIKE

In the manufacture of small electronic parts, such as capacitors, it is conventional practice to wrap about the part a length of adhesive tape which is wider than the part is long to provide an empty space at each end which is then sealed with epoxy or the like. Sophisticated machines have been designed for automatic wrapping of parts on a high production basis. Such machines are expensive and require considerable set up time and are thus practical only for long runs. For shorter runs of capacitors and the like, it has been customary to wrap the units in tape by hand. The process is costly in terms of labor, and hand wrapping produces a less satisfactory and consistent result than where the wrapping is done by machine.

It is accordingly, an object of the present invention to provide a machine for wrapping capacitors and other parts with protective tape on a semi-automated basis which does not require the expense or set-up time of a fully automated machine but which is nonetheless capable of production rates which are comparable to automatic equipment.

It is a related object to provide a machine for the tape wrapping of capacitors and the like which may be used universally without set up or adjustment for parts having a wide range of diameter and cross section. It is, therefore, an object of the invention to provide a semi-automated wrapping machine which can go from one size and shape of part to another without interruption and which is nevertheless easy to use requiring a minimum of operating skills and in which high production rates can be achieved after brief introduction.

It is a general object of the present invention to provide a tape wrapping machine for capacitors and the like which is capable of producing a high quality product equal to that produced on expensive automated machines but which is simple in construction and which may be built and sold at a price which is only a small fraction of that of automated equipment having comparable production capability. It is, moreover, an object of the present invention to provide a wrapping machine for capacitors and the like which consists of a relatively limited number of moving parts of a type readily available and which is distinguished by a long, useful life free of maintenance problems.

It is yet another object of the invention to provide a wrapping machine which is capable of accommodating a wide range of shapes and sizes of parts without change, but which may be readily adapted to gross changes in size or shape in only a few minutes time and with simple substitution of resilient rollers of different diameter.

Other objects and advantages of the invention will become apparent by reading the attached detailed description and upon reference to the drawings in which.

Figure 1:
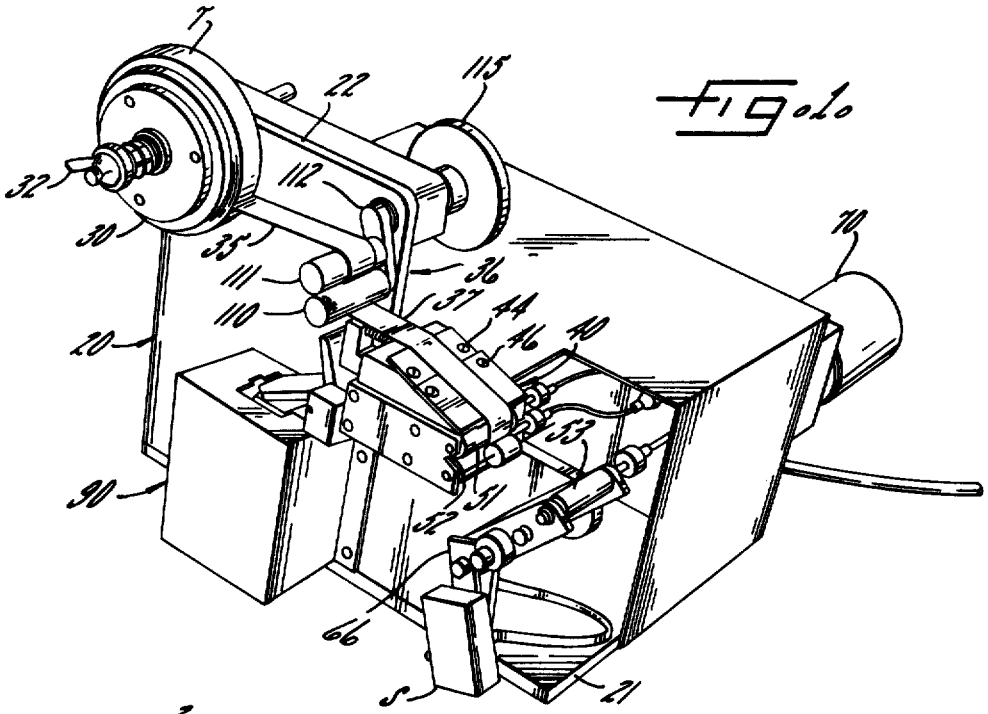
FIG. 1 is a general perspective view of a machine constructed in accordance with the invention.

FIGS. 9–14 inclusive show a typical operating sequence.

While the invention has been described in connection with a preferred embodiment, it will be understood that we do not intend to be limited to the particular embodiment shown but intend, on the contrary, to cover the various alternative and equivalent constructions included within the spirit and scope of the claims.

Turning now to the drawings, there is disclosed a tape wrapping machine having a frame 20 which includes a base plate 21 and vertical mounting plate 22, as well as second and third mounting plates 23, 24 spaced therefrom and to which reference will be made.

Mounted at the rear of the machine upon frame plate 22 is a mandrel 30 for supporting a roll of tape T. The mandrel is mounted upon a shaft 31 which is threaded and provided with an adjusting nut 32. For the purpose of varying the amount of drag, a slip clutch 33 is used, with the clutch faces being pressed together by a spring 34, the force of which is adjustable by the nut 32. Tape is led off of the roll along an initial path 35 through a step advancing, or pre-strip, mechanism generally indicated at 36 to which reference will be made. At the exit of the mechanism 36, the tape follows a second and final path 37. The end of the tape 38 is supported on a small forwardly inclined table 40 where the workpiece is pressed into engagement with the sticky side of the tape.

The front edge of the table terminates in a front lip 41. The table is supported upon a wedge-shaped mounting block 42. The upper portion 43 of the table, secured by screws 44, is preferably of magnetic material for a purpose to be described, while the lower portion 45 which merges smoothly therewith, and which is secured by screws 46, is formed of plastic such as teflon having anti-static characteristics so that the tape, which is usually of mylar, will not tend to cling to the table surface.

Arranged below the lip 41 of the table is a roller assembly 50 which includes a first roller 51, a second roller 52, and a third roller 53. The rollers 51, 52 are journaled in a subframe 54 and have shafts 55 and 56 which extend horizontally and which are vertically aligned upon centers which are spaced to provide clearance between the roller surfaces. The roller 53 is, similarly, provided with a shaft 57, the roller shafts being arranged as shown in a triangular locus defining a central triangular space 58.

For the purpose of mounting the third roller 53 so that it is movable broadwise with swinging action toward and away from the other two rollers, while keeping the rollers in their triangular relationship, the shaft 57 of the third roller is mounted upon an arm 60 which is pivoted for fore-and-aft rocking movement about a transversely extending shaft 61 secured to the mounting plate 22. For journaling the shaft 57 the arm 60 has a bracket, or extension, consisting of two side pieces 63 and 64 secured in place by a mounting screw 65. For manually rocking the arm 60, it includes a handle 66 which is secured to the arm by means of a screw 67 and which carries a switch S, to which reference will be made.

Figure 2:
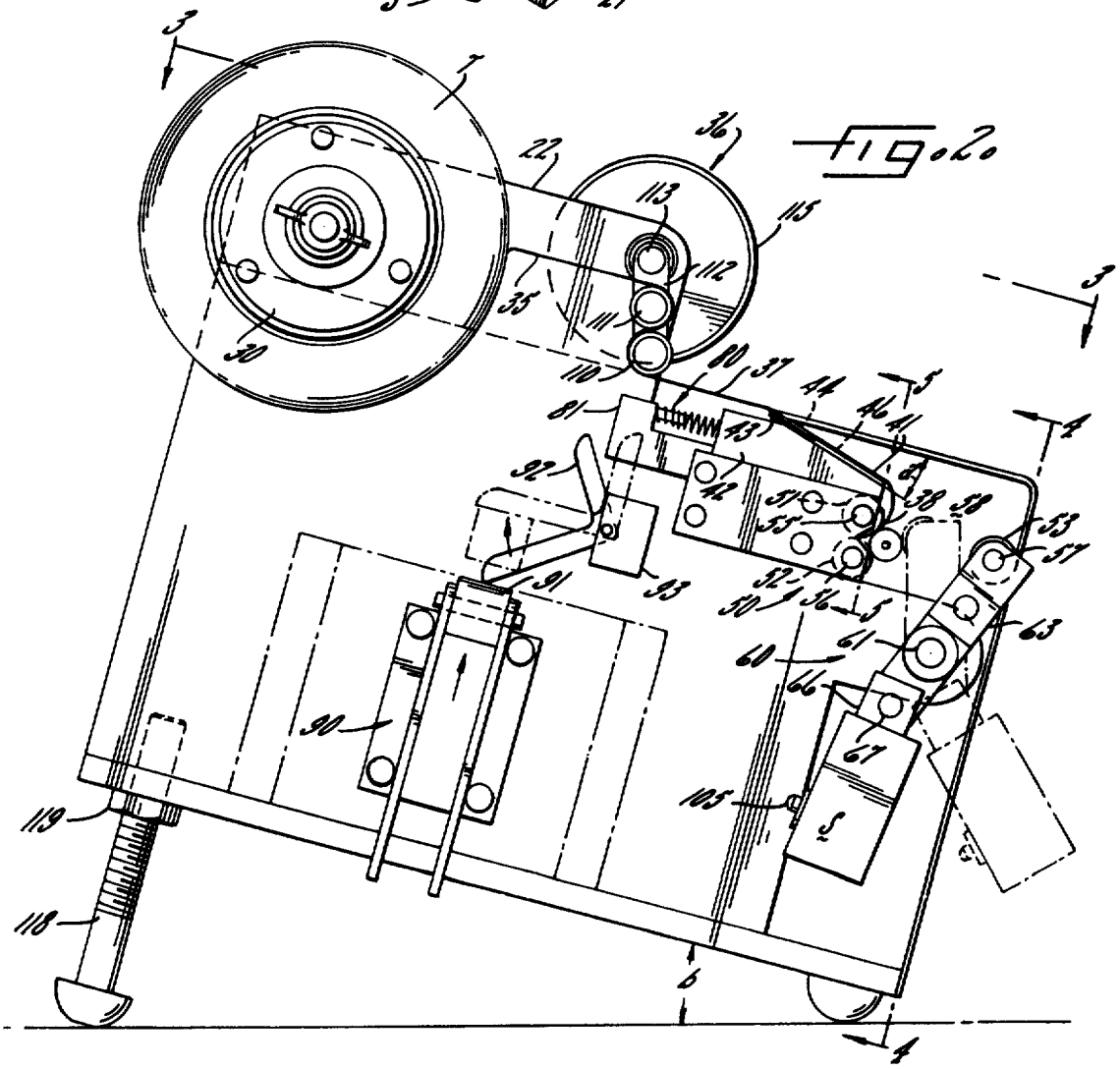
FIG. 2 is a side elevation of the machine shown in FIG. 1.
Figure 3:
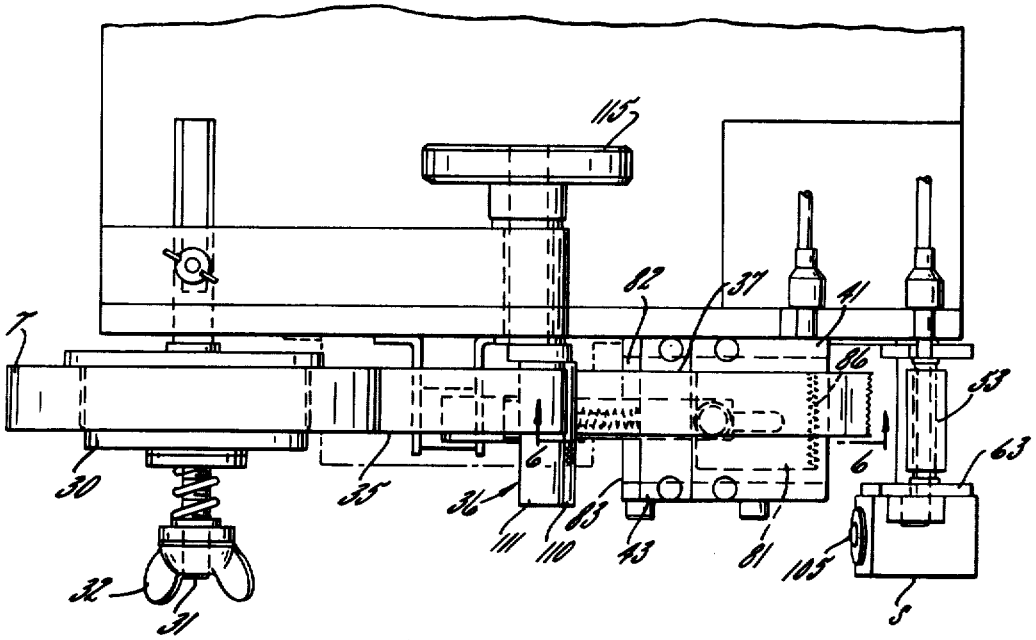
FIG. 3 is a top view of the machine illustrated in FIG. 2.
Figure 4:
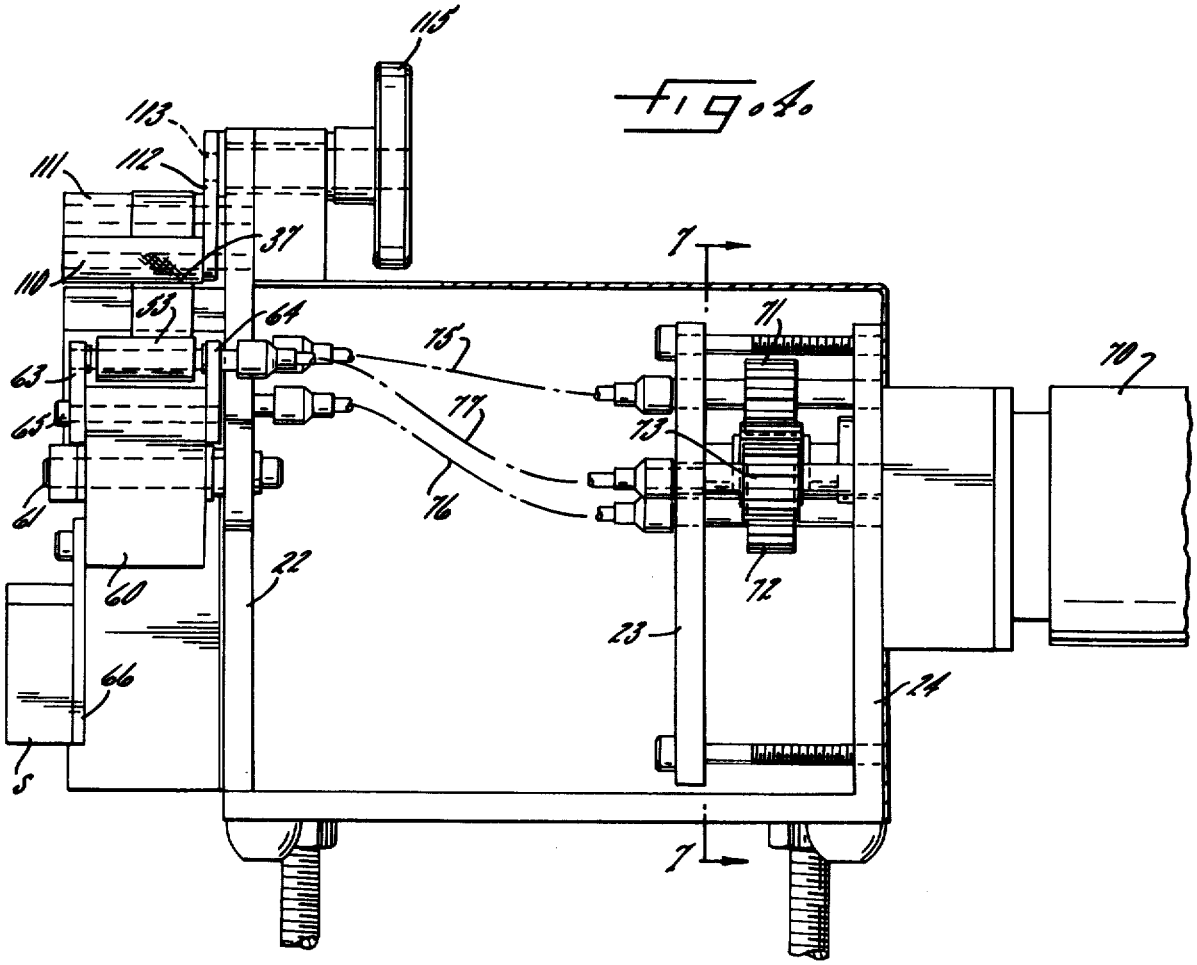
FIG. 4 is a front view of the same machine.
Figure 5:
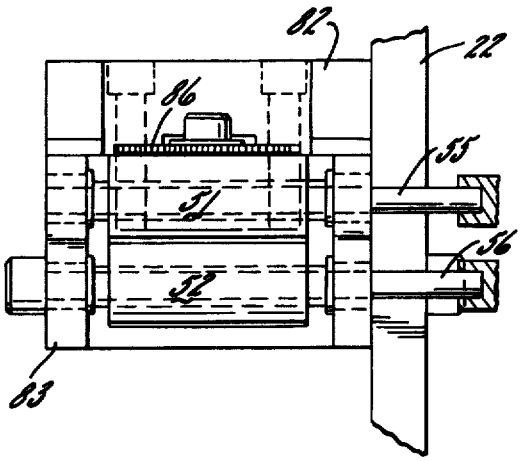
FIG. 5 is a fragmentary section looking along the line 5--5 in FIG. 2.
Figure 7:
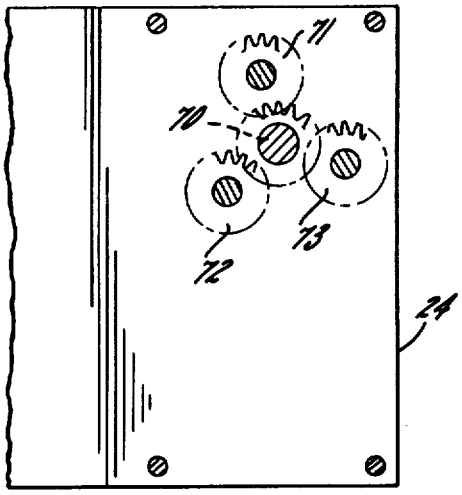
FIG. 7 is a fragmentary vertical section looking along line 7—7 in FIG. 4, showing the gear driving arrangement.
Figure 6:
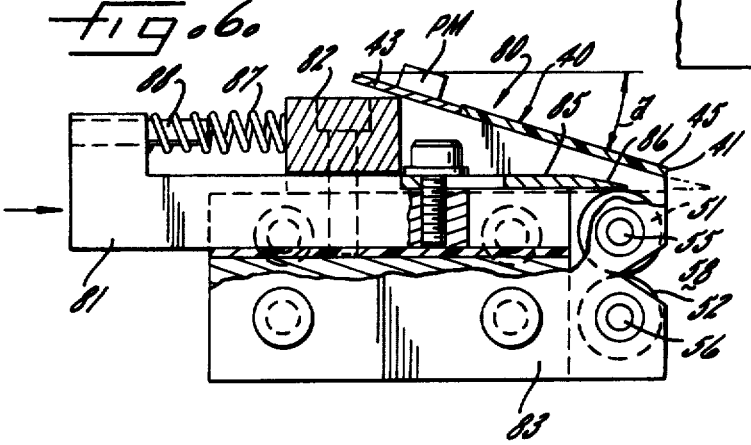
FIG. 6 is a fragmentary vertical section taken along line 6—6 in FIG. 3, showing the cutter mechanism in cross section.

For the purpose of rotating the rollers 51, 52 and 53 in the same direction and at the same peripheral speed, a motor 70 is provided, mounted upon plate 24, and having a pinion which simultaneously meshes with gears 71, 72 and 73 which are connected to flexible drive shafts 75, 76 and 77. The latter are coupled at their left-hand ends (as viewed in FIG. 4) to the ends of the shafts 55, 56 and 57 which rotate the three rollers. The flexibility of the shaft 77 is sufficient to enable the arm 60 to be rocked from the position shown in full lines in FIG. 2 to the dot-dash position as required for admission of a work piece to the triangular space between the rollers. The motor and gear ration are so selected as to rotate the rollers at a speed on the order of 100 rpm. Using rollers 9/16 inch in diameter, this amounts to a peripheral speed on the order of 200 inches per minute. The rollers are preferably resiliently surfaced with urethane plastic having a durometer rating of 85. For the purpose of cutting the tape, a cutter mechanism is provided which includes a reciprocated blade which is mounted directly below the front lip of the table in a position between the lip of the table and the roller assembly. Referring particularly to FIGS. 2, 3 and 7, the cutter mechanism generally indicated at 80 includes a body or slide 81 which is mounted between way members 82 and 83 (see FIG. 3). At the front of the slide 81 is mounted a blade 85 having a serrated front edge 86. The slide 81 and its blade 85 are spring biased to a retracted position by means of a spring 87, the position being determined by a stop 88 (FIG. 6).

For impulsing the cutter mechanism, a solonoid 90 is provided having an armature 91 which engages a bell crank 92 pivoted to a pedestal 93. Upward movement of the armature causes the bell crank to rock clockwise, engaging the slide 81 to thrust the edge 86 of the knife out to engage the tape which is trained over the forward lip 41 of the table, as will be described.

Figure 8:
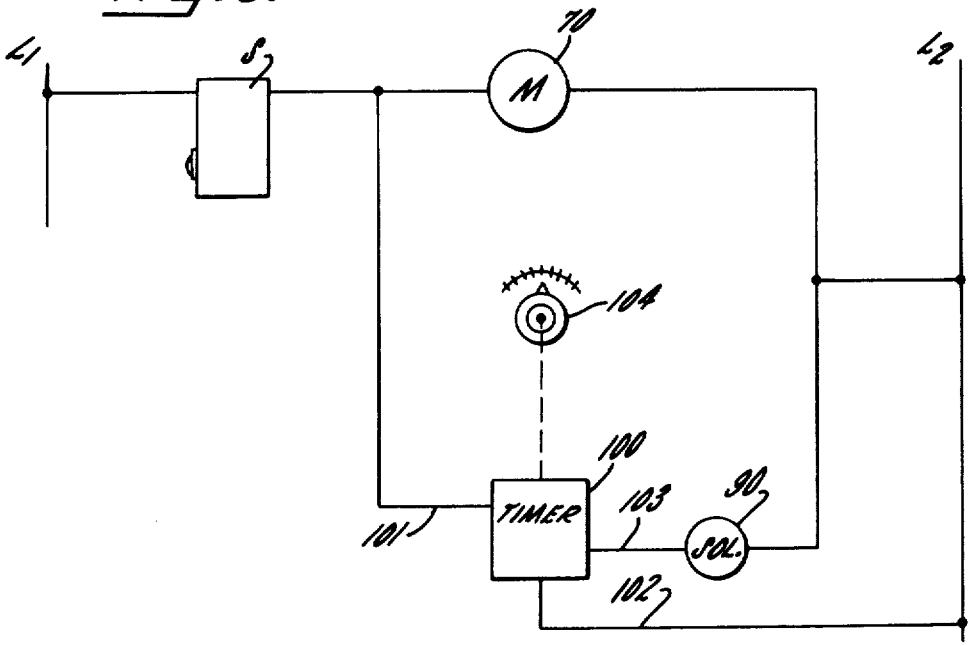
FIG. 8 shows a simplified control circuit employed for the motor and cutter mechanism.

Having described the motor 70 and solonoid 90, reference may now be made to the simplified control circuit shown in FIG. 8, in which it may be noted that the switch S on the handle is connected in series with the motor across supply lines L-1 and L-2. Connected in parallel with the motor is a circuit which includes a timer 100 having a common line 101 and a supply line 102 and a controlled line 103. The controlled line serves to feed the solenoid. The timer is so constructed that when voltage is applied across lines 101 and 102, a voltage will not exist on the controlled line 103 for a predetermined time interval, which is set by an adjustable control 104. Timers of this types are a staple item commonly available and the internal circuit of the timer need not be discussed. It is preferred to have a timer which is adjustable within the range of 0 to 1½ seconds.

It will be apparent, then, that when the handle 66 is grasped to swing the movable roller 53 toward the companion rollers, the same movement of the hand may operate plunger 105 on the switch. This immediately sets the motor 70 in motion and starts the timer. Approximately one second later, depending upon the time for which the timer has been set, the solonoid 90 is automatically energized projecting the edge of the cutter into the tape and severing it to complete the tape winding operation, whereupon the switch plunger 105 may be released and the handle 66 rotated in a direction to free the workpiece.

Attention may be given to a means for initially contacting the end of the tape with a workpiece and for preliminarily advancing the tape through a step up motion so that the workpiece, adhering to the end of the tape, is lowered from a position at the front lip of the table to a position directly in front of the rollers 51 and 52 in readiness for engagement by the roller 53. This will be explained in detail in connection with the discussion of the operating sequence set forth in FIGS. 9–14. In accordance with the invention, a knurled roller is interposed between the roll of tape and the table. Means are provided for guiding the tape in a loop with the sticky side facing the knurled roller and for moving the knurled roller away from the table to increase the length of the loop and, subsequently, toward the table for preliminary feeding of a predetermined length of tape. Referring to the step advancing mechanism 36, it includes a knurled roller 110 and auxiliary roller 111. The rollers are secured to an arm or carrier 112, which has a shaft 113 which is spaced substantially above the axis of the knurled roller. The shaft 113 is mounted transversely at the upper edge of the mounting plate 22 and terminates in a hand wheel 115 which is positioned to be operated by the right hand of the operator.

A typical sequence of operation is set forth beginning with FIG. 9. As shown in this figure, the end 38 of the tape extends to the front lip 41 of the table 40. A workpiece W in the form of a small, cylindrical capacitor, having an axial dimension which is less than the width of the tape, is centered upon the tape in the position shown and pressed, with the left hand, firmly against the sticky side of the tape. This immobilizes the end of the tape.

Next, the hand wheel 115 is rotated clockwise, that is to say, in a direction to swing the knurled roller 110 away from the table and toward the roll of tape. This in effect lengthens the total run of tape between the roll and the end 38 of the tape, causing the tape to be "prestripped" from the surface of the roll. The workpiece W is then released and the hand wheel 115 is rotated counterclockwise, with the knurled roller 110 being swung in the direction of the table 40. As shown in FIG. 11, this permits the workpiece adhering to the end of the tape to drop into a position centered between the rollers 51 and 52. Where the tape is relatively thick and stiff, the endwise push applied to the tape may be sufficient to cause the workpiece to fall over the lip of the table. However, the thin mylar tape usually employed in the wrapping of capacitors is extremely thin. Consequently, to insure that the workpiece drops clear of the table, the table is preferably forwardly inclined by an angle indicated at *a* in FIG. 2. To increase the effective angle, the frame has provision for bodily tilting to an angle *b* as shown in the same figure. This bodily tilting is brought about by rear legs 118 which are adjustable, held by jam nuts 119. Thus, the total angle of forward incline of the table 40 relative to the horizontal is the sum of the angles *a* and *b*. In short, the total angle of incline of the table is sufficiently steep so that the weight of the workpiece is sufficient to pull the terminal portion 37 of the tape across the table when the knurled roller 110 is swung forwardly in the direction of the table.

With the workpiece in the position of readiness, then, as shown in FIG. 11, the handle 66 is grasped by the left hand of the operator and rocked upwardly about the shaft 61, thereby swinging the roller 53 into engagement with the workpiece as illustrated in FIG. 12. At the same time, the plunger 105 of the switch S is pressed turning on the motor 70 and starting the timer. The turning on of the motor causes the rollers 51–43 to rotate simultaneously in the same direction, that is, in the direction of the arrows shown in FIG. 12, so that the workpiece is rotated. The resultant wrapping of the tape upon the workpiece pulls additional tape from the roll, with the tape flowing from the roll about knurled roller 110 and across table 40. After expiration of an adjusted time delay, depending upon the setting of the timer 100, the solenoid is impulsed, driving the blade 85 forwardly so that the cutting edge 86 engages the tape as it is fed over the lip 41 of the table. The motor continues to rotate even after cutting has been completed, so that the tail end of the tape on the workpiece is wiped smoothly and tightly into position. The operator is then free to release the switch plunger 105 to stop the motor and to rock the handle 66 swinging the roller 53 backwardly and allowing the completed workpiece to drop clear. This restores the device to the condition shown in FIG. 9.

As an optional operating feature, the movement of the knurled roller 110 away from the table, that is, in the pre-strip direction, may be performed during the time that wrapping of one unit is taking place, in readiness for the advancement of the next unit. This is illustrated in FIG. 13 which corresponds to FIG. 12 except that the hand wheel 115 has been rotated clockwise. Such early rotation of the hand wheel might be referred to, for convenience, as pre-pre-strip. Where this is done, the motion of the handle must be completed before cutting occurs, so that upon operation of the cutter the leading edge of the tape will occupy a position close to the lip 41 of the table in readiness for the pressing on of a new workpiece.

The only element in the operation of the machine which requires exercise of judgment is the amount of rotation of the hand wheel which is required to drop the workpiece from the lip of the table to a position centered between rollers 51 and 52. It is found that the operator within a very few minutes develops a "feel" for this so that operation of the machine thereafter is practically automatic. However, if desired, stops indicated at 121, 122 may be interposed in the path of swinging movement of the arm 112 (see FIG. 9).

The device described is capable of production rates on the order of 6,000 units in a typical working day. However, it will be apparent that the machine is susceptible to additional features of automation at little or no complication or expense. For example, the switch S which is mounted upon the handle 66 so as to be pressed when the handle is grasped, may, instead, be mounted stationarily in the path of swinging movement of the arm 60 which supports the roller 53 so as to operate the motor as the rollers come into engagement with the workpiece. Or, if desired, the switch S may be made pressure responsive—responsive to the reaction pressure exerted upon the rollers, a matter well within the skill of the art.

It is one of the worthwhile features of the construction that moving the tape off center upon the table 40 does not cause the tape to subsequently trail off either to the right or the left. The reason for this is that the run of tape has two portions, the first captive portion 35 and the second portion 37 separated by a pass of the sticky side of the tape around knurled roller 110. Thus, swinging the terminal portion of the tape 37 either to the right or the left on the table does not effect the true run of the tape from the roll to the auxiliary roller 111 because of the isolating action of the knurled roller.

It is a further feature of the construction that pre-stripping occurs generally in line with the table without any lifting of the tape to form a loop. Thus, the stress applied to the tape during pre-strip is in line with the table and easily resisted by the tackiness of the tape against the workpiece (FIG. 10).

It is found in practice that the timer 100 serves as an accurate gauge of the amount of tape which is wound about each of the units, so that there is a high degree of consistency from unit to unit. Thus, there is insurance that the specifications will be met while nevertheless effecting the wrap in a minimum amount of time and using a minimum amount of tape. This is contrasted with arrangements in which a knurled roller is employed with a half-nut as a metering device and where engagement of the half nut is somewhat indeterminate.

While the invention has been described in connection with a cylindrical workpiece, typically a small capacitor, it has been found that the machine works exceedingly well in winding other symmetrically shaped parts which are not of circular cross section and which may, for example, be of square or rectangular cross section. Moreover, it is found that the same set of rollers 51–53 may be used for a wide range of part diameter. Because of this and the lack of necessity for other adjustments, short runs of capacitors or similar parts which vary in size and shape may be accommodated without readjustment and without breaking the tempo of the machine.

While the lateral positioning of the end 38 of the tape is not critical, nevertheless to keep the tape in its centered position on the table, it may be desirable to employ guides, for example, guides in the form of small, permanent magnets indicated at PM in FIG. 6, which adhere to the upper, magnetic portion of the table 43.

The term "knurled" is intended to cover any roller which, because of its surfacing, sticks only lightly to the sticky surface of the tape.

While the term "table" has been applied to element 40 it will be understood that this refers broadly to any small temporary supporting surface. The term "pre-strip" refers to initial removal of tape from the supply roller which takes place prior to, and in preparation for, rotation of the parts by the rollers.

What is claimed is:

1. In a taping machine for applying a protective wrapping to small parts of the type having a longitudinal axis, the combination comprising a frame, means on the frame for supporting a supply roll of adhesive tape, the front of the frame presenting a table surface having a front lip, first horizontally extending roller means alined below the lip of the table, the first roller means being axially fixed in position, a cutter mechanism including a reciprocating cutter blade fitted snugly under the lip of the table and above the roller means, second roller means opposite the first roller means and parallel thereto, a movable arm supporting the second roller means and having a handle for manual movement of the arm toward and away from the first roller means to define a captive winding space, means for driving both roller means in the same direction and at the same peripheral speed, means for guiding the tape along the surface of the table with the end of the tape extending to the lip of the table sticky side up so that a part may be manually pressed adheringly to the end of the tape in a transversely extending direction, a transversely extending knurled roller between the roll of tape and the table, a carrier mounting the knurled roller for bodily movement generally horizontally toward and away from the table, means including a cylindrical guide member spaced from the knurled roller and parallel thereto for guiding and restraining the back side of the tape so that the tape follows an S-shaped path terminating at the lip of the table and in which the sticky side forms a partial loop about the knurled roller, manually operated means for (a) moving the carrier away from the table while the part is pressed against the tape to prevent retrograde movement of the end of the tape so that the loop is elongated with the result that the knurled roller "takes" a length of tape from the supply roll and for (b) subsequently moving the carrier toward the table to shorten the loop and so that the end of the tape is advanced across the table with the result that the part adhering to the tape drops over the lip of the table and into the space between the roller means where, upon manual movement of the arm, it is trapped in the captive winding space, means for actuating the driving means so that the rollers rotate the part drawing the tape around the knurled roller and which is then wound about the part, and means for operating the cutter mechanism to sever the tape for release of the part.

2. The combination as claimed in claim 1 in which the path of movement of the knurled roller is in a direction generally alined with the surface of the table so that upon return movement of the carrier the tape with its sticky side up is pushed endwise toward the lip of the table with the part adhering to the tape dropping by action of gravity from the lip of the table.

3. The combination as claimed in claim 1 in which the table is tilted forwardly toward the lip thereof so that when the carrier is moved toward the table the end of the tape, with the part adhering thereto, slides along the table and drops over the lip of the table under the action of gravity to a position between the roller means.

4. The combination as claimed in claim 1 in which the carrier is in the form of a vertically extending arm swingable about a transverse axis and in which the knurled roller and cylindrical guide member are mounted one above the other on the arm with the knurled roller positioned at the end of the arm.

5. The combination as claimed in claim 1 in which the movable arm has an operating handle having a switch mounted thereon and in which the driving means includes a motor connected to the switch so that when the operator of the machine grasps the handle to bring the roller means into engagement with the part the switch is simultaneously operated to cause the driving means to rotate the part.

6. The combination as claimed in claim 5 in which a timing circuit is interposed between the switch and the cutter mechanism so that the cutter mechanism is automatically operated after a predetermined amount of tape has been applied to the part.

7. The combination as claimed in claim 1 in which the driving means for the first and second roller means is in the form of an electric driving motor and in which a flexible cable type drive connection is interposed between the motor and the second roller means to permit driving of the second roller means over the range of movement of the movable arm which supports the second roller means.

* * * * *